US011125106B2

(12) United States Patent
Pratt et al.

(10) Patent No.: US 11,125,106 B2
(45) Date of Patent: Sep. 21, 2021

(54) SYNCHRONIZING RING SURGE BUMPER

(71) Applicant: United Technologies Corporation, Farmington, CT (US)

(72) Inventors: William S. Pratt, West Hartford, CT (US); Ryan M. Stanley, Quaker Hill, CT (US); Adam Hart, East Hampton, CT (US)

(73) Assignee: Raytheon Technologies Corporation, Farmington, CT (US)

( * ) Notice: Subject to any disclaimer, the term of this patent is extended or adjusted under 35 U.S.C. 154(b) by 33 days.

(21) Appl. No.: 16/561,540

(22) Filed: Sep. 5, 2019

(65) Prior Publication Data

US 2021/0071543 A1 Mar. 11, 2021

(51) Int. Cl.
*F01D 17/16* (2006.01)
*F04D 29/54* (2006.01)

(52) U.S. Cl.
CPC ..... *F01D 17/162* (2013.01); *F04D 29/542* (2013.01)

(58) Field of Classification Search
CPC .... F01D 17/162; F04D 29/444; F04D 29/462; F04D 29/542; F04D 29/563; F02C 9/20; F02C 9/22
USPC ..... 415/149.2, 149.4, 159–162
See application file for complete search history.

(56) References Cited

U.S. PATENT DOCUMENTS

| | | | | |
|---|---|---|---|---|
| 4,812,106 | A * | 3/1989 | Purgavie | F01D 17/162 415/139 |
| 7,553,127 | B2 | 6/2009 | Noelle | |
| 9,353,644 | B2 | 5/2016 | LeBlanc et al. | |
| 9,429,033 | B2 | 8/2016 | Martin et al. | |
| 9,617,869 | B2 | 4/2017 | LeBlanc et al. | |
| 10,161,407 | B2 | 12/2018 | St. Mary et al. | |
| 2010/0189549 | A1* | 7/2010 | Gilman | F04D 29/563 415/148 |
| 2014/0050567 | A1* | 2/2014 | LeBlanc | F01D 17/162 415/148 |
| 2015/0184535 | A1* | 7/2015 | Dougherty | F02C 9/20 415/1 |
| 2018/0163565 | A1 | 6/2018 | McGuire, II et al. | |

FOREIGN PATENT DOCUMENTS

| | | | |
|---|---|---|---|
| EP | 3333375 | A1 | 6/2018 |
| WO | 2014200680 | A1 | 12/2014 |

OTHER PUBLICATIONS

EP Search Report dated Jan. 11, 2021 issued for corresponding European Patent Application No. 20184327.3.

* cited by examiner

*Primary Examiner* — Christopher Verdier
(74) *Attorney, Agent, or Firm* — Bachman & LaPointe, P.C.

(57) ABSTRACT

A synchronizing ring assembly includes a synchronizing ring portion that has a first and a second distal end, the first and the second distal end each form an integrated surge bumper.

14 Claims, 8 Drawing Sheets

SYNCHRONIZING RING SURGE BUMPER

U.S. GOVERNMENT RIGHTS

This invention was made with Government support awarded by the United States. The Government has certain rights in this invention.

BACKGROUND

The present disclosure relates to a gas turbine engine and, more particularly, to a synchronization ring therefor.

Gas turbine engines, such as those that power modern commercial and military aircraft, generally include a compressor section to pressurize an airflow, a combust section to burn a hydrocarbon fuel in the presence of the pressurized air, and a turbine section to extract energy from the resultant combustion gases.

Some gas turbine engines include variable stater vanes that can be pivoted about their individual axes to change an operational performance characteristic. Typically, the variable stater vanes are robustly designed to handle the stress loads that are applied to change the position of the vanes. A mechanical linkage is typically utilized to rotate the variable stater vanes. Because forces on the variable stater vanes can be relatively significant, forces transmitted through the mechanical linkage can also be relatively significant. Legacy designs typically utilize fueldraulic actuation to rotate the variable stator vanes.

The variable stator vanes are typically actuated by a synchronizing ring assembly. This synchronizing ring interfaces with the engine case via bumpers (also commonly called runners) that are either composite or metallic with a protective coating, depending on metal temperature. During a high power engine stall event, high surge loading can cause excessive ring deflection. This most often results in radially inboard deflection where the actuation system connects to the sync ring, and radially outboard deflection somewhere else along the ring (in the case of a dual actuation system, 90° clockwise and counter-clockwise). Excessive deflection can result in vane arm radial deflection, which can lead to loss of vane control, rotor excitations and potential engine shutdowns. In high vane count stages, deflection control can be a challenge due to bumper mounting space near the connection point being reserved for bolting the synchronizing ring to the splice plate or bridge bracket that steps over the case split flange.

SUMMARY

A synchronizing ring assembly according to one disclosed non-limiting embodiment of the present disclosure includes a synchronizing ring portion that has a first and a second distal end, the first and the second distal end each form an integrated surge bumper, wherein the synchronizing ring portion defines a first height throughout a span which increases to a second height at the distal end to form the integrated surge bumper.

A further embodiment of any of the foregoing embodiments of the present disclosure includes that the synchronizing ring portion defines a first height throughout the span which extends along a ramp to the second height.

A further embodiment of any of the foregoing embodiments of the present disclosure includes that the synchronizing ring portion is of a 180 degree arc length.

A further embodiment of any of the foregoing embodiments of the present disclosure includes that each integrated surge bumper is of an arc length that is 2-5% that of the synchronizing ring portion.

A further embodiment of any of the foregoing embodiments of the present disclosure includes that each integrated surge bumper provides a build gap of greater than a minimum gap with respect to an outer surface of an outer case.

A further embodiment of any of the foregoing embodiments of the present disclosure includes a multiple of bumper assemblies mounted to the synchronizing ring portion.

A further embodiment of any of the foregoing embodiments of the present disclosure includes that each bumper assembly provides a build gap greater than a minimum gap with respect to the outer surface of the outer case.

A further embodiment of any of the foregoing embodiments of the present disclosure includes that the build gap of the integrated surge bumper is 4-5 times that of the bumper assembly.

A further embodiment of any of the foregoing embodiments of the present disclosure includes that the minimum gap of the integrated surge bumper is 15-17 times that of the bumper assembly.

A further embodiment of any of the foregoing embodiments of the present disclosure includes that each integrated surge bumper includes a clevis bridge bracket attachment passage.

A further embodiment of any of the foregoing embodiments of the present disclosure includes a clevis bridge bracket attachment passage fastened to the synchronizing ring portion.

A synchronizing ring assembly according to one disclosed non-limiting embodiment of the present disclosure includes a first synchronizing ring portion that has a first and a second distal end, the first and the second distal end each form an integrated surge bumper; a second synchronizing ring portion that has a first and a second distal end, the first and the second distal end each form an integrated surge bumper; a first clevis bridge bracket fastened to the first synchronizing ring portion and the second synchronizing ring portion; a second clevis bridge bracket fastened to the first synchronizing ring portion and the second synchronizing ring portion; a multiple of bumper assemblies fastened to the first synchronizing ring portion; and a multiple of bumper assemblies fastened to the second synchronizing ring portion.

A further embodiment of any of the foregoing embodiments of the present disclosure includes that the first and second synchronizing ring portion each defines a first height throughout a span and a second height at the first and second distal end to form the integrated surge bumper, each integrated surge bumper includes a clevis bridge bracket attachment passage.

A further embodiment of any of the foregoing embodiments of the present disclosure includes that each integrated surge bumper provides a build gap greater than and a minimum gap with respect to an outer surface of an outer case.

A further embodiment of any of the foregoing embodiments of the present disclosure includes that each bumper assembly provides a build gap greater than a minimum gap with respect to the outer surface of the outer case.

A further embodiment of any of the foregoing embodiments of the present disclosure includes that the build gap of the integrated surge bumper is 4-5 times that of the bumper assembly.

A further embodiment of any of the foregoing embodiments of the present disclosure includes that the minimum gap of the integrated surge bumper is 15-17 times that of the bumper assembly.

A method of controlling a deflection of a synchronizing ring assembly during a surge event in a gas turbine engine according to one disclosed non-limiting embodiment of the present disclosure includes providing a build gap with respect to an outer surface of an outer engine case for an integrated surge bumper at each distal end of a synchronization ring portion that is 4-5 times that of a bumper assembly attached to the synchronization ring portion; and providing a minimum gap with respect to the outer surface of the outer engine case for the integrated surge bumper at each distal end of the synchronization ring portion that is 15-17 times that of the bumper assembly attached to the synchronization ring portion.

A further embodiment of any of the foregoing embodiments of the present disclosure includes providing a rotational input to the synchronizing ring assembly through a clevis bridge bracket fastened to the synchronizing ring portion.

The foregoing features and elements may be combined in various combinations without exclusivity, unless expressly indicated otherwise. These features and elements as well as the operation thereof will become more apparent in light of the following description and the accompanying drawings. It should be appreciated, however, the following description and drawings are intended to be exemplary in nature and non-limiting.

BRIEF DESCRIPTION OF THE DRAWINGS

Various features will become apparent to those skilled in the art from the following detailed description of the disclosed non-limiting embodiment. The drawings that accompany the detailed description can be briefly described as follows.

DETAILED DESCRIPTION

Figure 1:
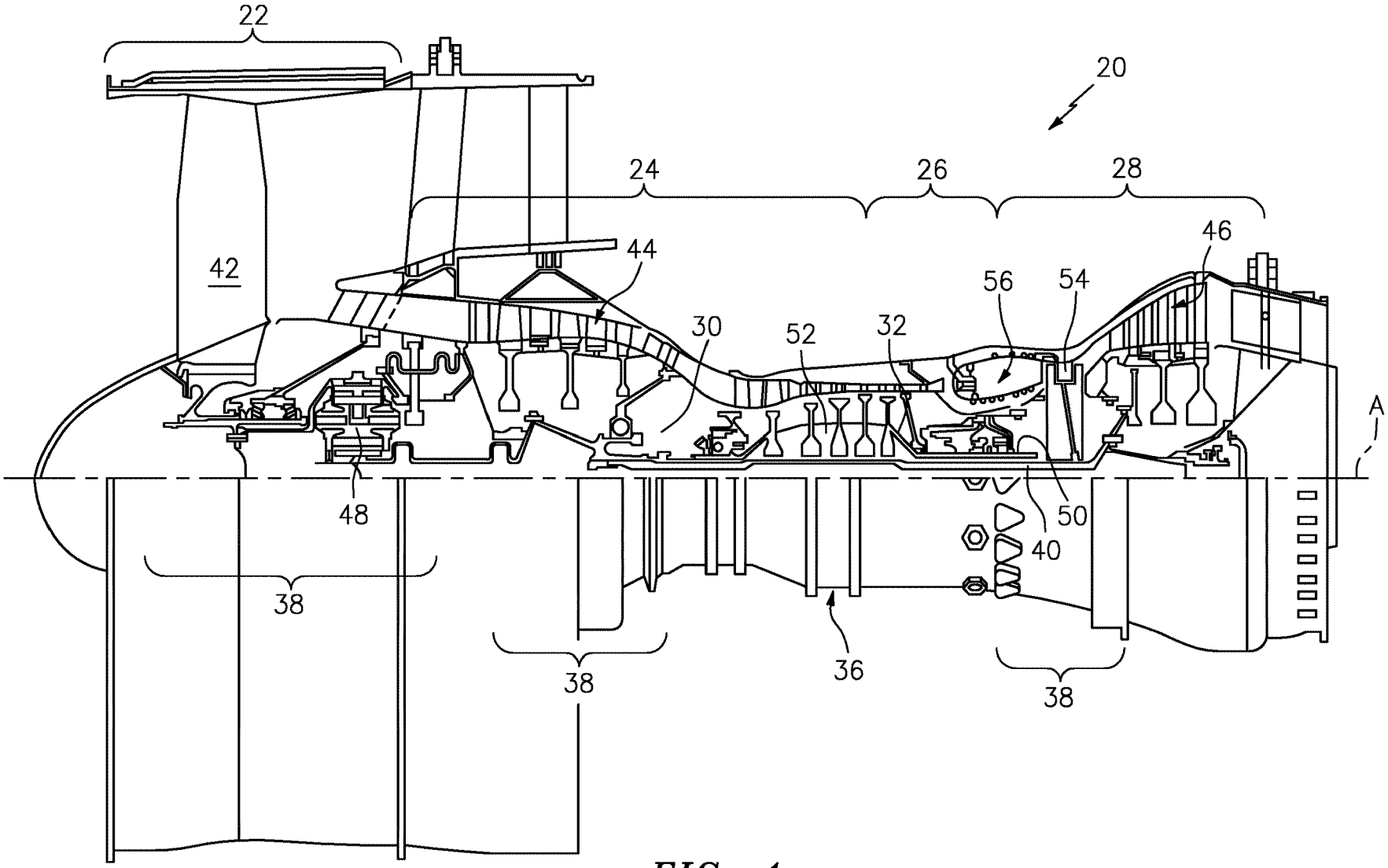
FIG. 1 is a schematic cross-section of an example gas turbine engine architecture.

FIG. 1 schematically illustrates a gas turbine engine 20. The gas turbine engine 20 is disclosed herein as a two-spool GTF (geared turbofan) that generally incorporates a fan section 22, a compressor section 24, a combustor section 26 and a turbine section 28. Alternative engine architectures might include an augmentor section and exhaust duct section (not shown) among other systems or features. The fan section 22 drives air along a bypass flowpath while the compressor section 24 drives air along a core flowpath for compression and communication into the combustor section 26 then expansion thru the turbine section 28. Although depicted as a GTF in the disclosed non-limiting embodiment, it should be understood that the concepts described herein are not limited to use with GTF as the teachings may be applied to other types of turbine engines such as a Direct-Drive-Turbofan with high, or low bypass augmented turbofan, turbojets, turboshafts, and three-spool (plus fan) turbofans wherein an intermediate spool includes an intermediate pressure compressor ("IPC") between a Low Pressure Compressor ("LPC") and a High Pressure Compressor ("HPC"), and an intermediate pressure turbine ("IPT") between the high pressure turbine ("HPT") and the Low pressure Turbine ("LPT").

The engine 20 generally includes a low spool 30 and a high spool 32 mounted for rotation about an engine central longitudinal axis A relative to an engine static structure 36 via several bearing compartments 38. The low spool 30 generally includes an inner shaft 40 that interconnects a fan 42, a low pressure compressor 44 ("LPC") and a low pressure turbine 46 ("LPT"). The inner shaft 40 drives the fan 42 directly or thru a geared architecture 48 to drive the fan 42 at a lower speed than the low spool 30. An exemplary reduction transmission is an epicyclic transmission, namely a planetary or star gear system.

The high spool 32 includes an outer shaft 50 that interconnects a high pressure compressor 52 ("HPC") and high pressure turbine 54 ("HPT"). A combustor 56 is arranged between the HPC 52 and the HPT 54. The inner shaft 40 and the outer shaft 50 are concentric and rotate about the engine central longitudinal axis A which is collinear with their longitudinal axes.

Core airflow is compressed by the LPC 44 then the HPC 52, mixed with fuel and burned in the combustor 56, then expanded over the HPT 54 and the LPT 46. The turbines 54, 46 rotationally drive the respective low spool 30 and high spool 32 in response to the expansion. The main engine shafts 40, 50 are supported at a plurality of points by the bearing compartments 38. It should be understood that various bearing compartments 38 at various locations may alternatively or additionally be provided.

In one example, the gas turbine engine 20 is a high-bypass geared aircraft engine with a bypass ratio greater than about six (6:1). The geared architecture 48 can include an epicyclic gear train, such as a planetary gear system or other gear system. The example epicyclic gear train has a gear reduction ratio of greater than about 2.3:1, and in another example is greater than about 3.0:1. The geared turbofan enables operation of the low spool 30 at higher speeds which can increase the operational efficiency of the LPC 44 and LPT 46 to render increased pressure in relatively few stages.

A pressure ratio associated with the LPT 46 is pressure measured prior to the inlet of the LPT 46 as related to the pressure at the outlet of the LPT 46 prior to an exhaust nozzle of the gas turbine engine 20. In one non-limiting embodiment, the bypass ratio of the gas turbine engine 20 is greater than about ten (10:1), the fan diameter is significantly larger than that of the LPC 44, and the LPT 46 has a pressure ratio that is greater than about five (5:1). It should be understood, however, that the above parameters are only exemplary of one embodiment of a geared architecture engine and that the present disclosure is applicable to other gas turbine engines including direct drive turbofans, where the rotational speed of the fan 42 is the same (1:1) of the LPC 44.

In one example, a significant amount of thrust is provided by the bypass flow path due to the high bypass ratio. The fan section 22 of the gas turbine engine 20 is designed for a particular flight condition—typically cruise at about 0.8 Mach and about 35,000 feet (10668 meters). This flight condition, with the gas turbine engine 20 at its best fuel consumption, is also known as bucket cruise Thrust Specific Fuel Consumption (TSFC). TSFC is an industry standard parameter of fuel consumption per unit of thrust.

Fan Pressure Ratio is the pressure ratio across a blade of the fan section 22 without the use of a Fan Exit Guide Vane system. The relatively low Fan Pressure Ratio according to one example gas turbine engine 20 is less than 1.45. Low Corrected Fan Tip Speed is the actual fan tip speed divided by an industry standard temperature correction of ("T"/518.7)$^{0.5}$ in which "T" represents the ambient temperature in degrees Rankine. The Low Corrected Fan Tip Speed according to one example gas turbine engine 20 is less than about 1150 fps (351 m/s).

Figure 2:
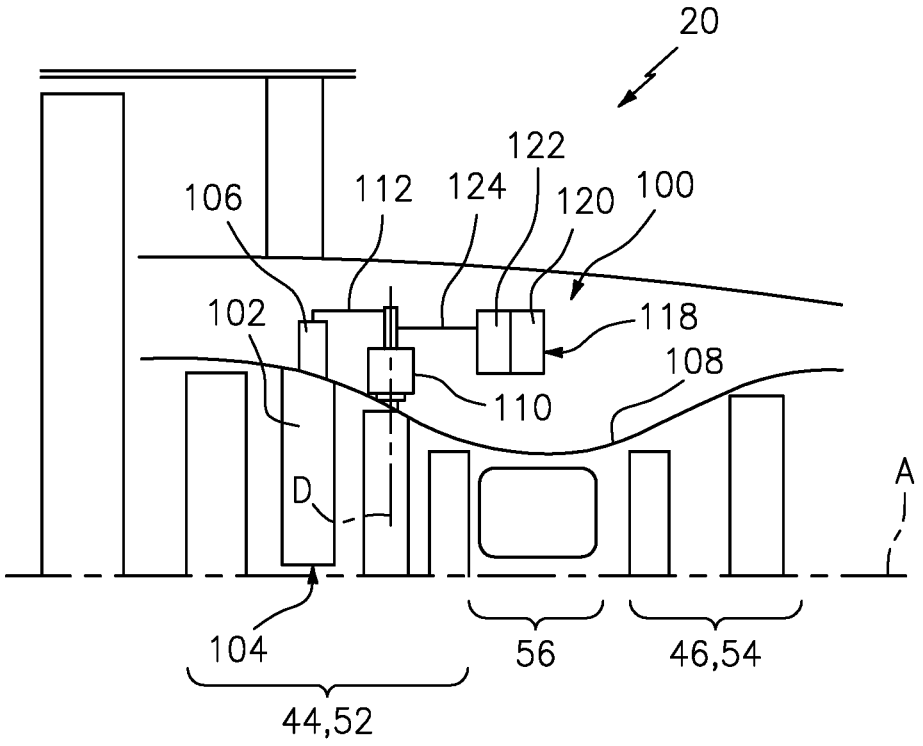
FIG. 2 is a schematic view of a variable vane system for a gas turbine engine.

With reference to FIG. 2, one or more stages of the LPC 44 and/or the HPC 52 include a variable vane system 100 that can be rotated to change an operational performance characteristic of the gas turbine engine 20 for different operating conditions. The variable vane system 100 may include one or more variable vane stages.

The variable vane system 100 may include a plurality of variable stator vanes 102 (also shown in FIG. 3) circumferentially arranged around the engine central axis A. The variable stator vanes 102 each include a variable vane body that has an airfoil portion that provides a lift force via Bernoulli's principle such that one side of the airfoil portion generally operates as a suction side and the opposing side of the airfoil portion generally operates as a pressure side. Each of the variable stator vanes 102 generally spans between an inner diameter and an outer diameter relative to the engine central axis A.

Figure 3:
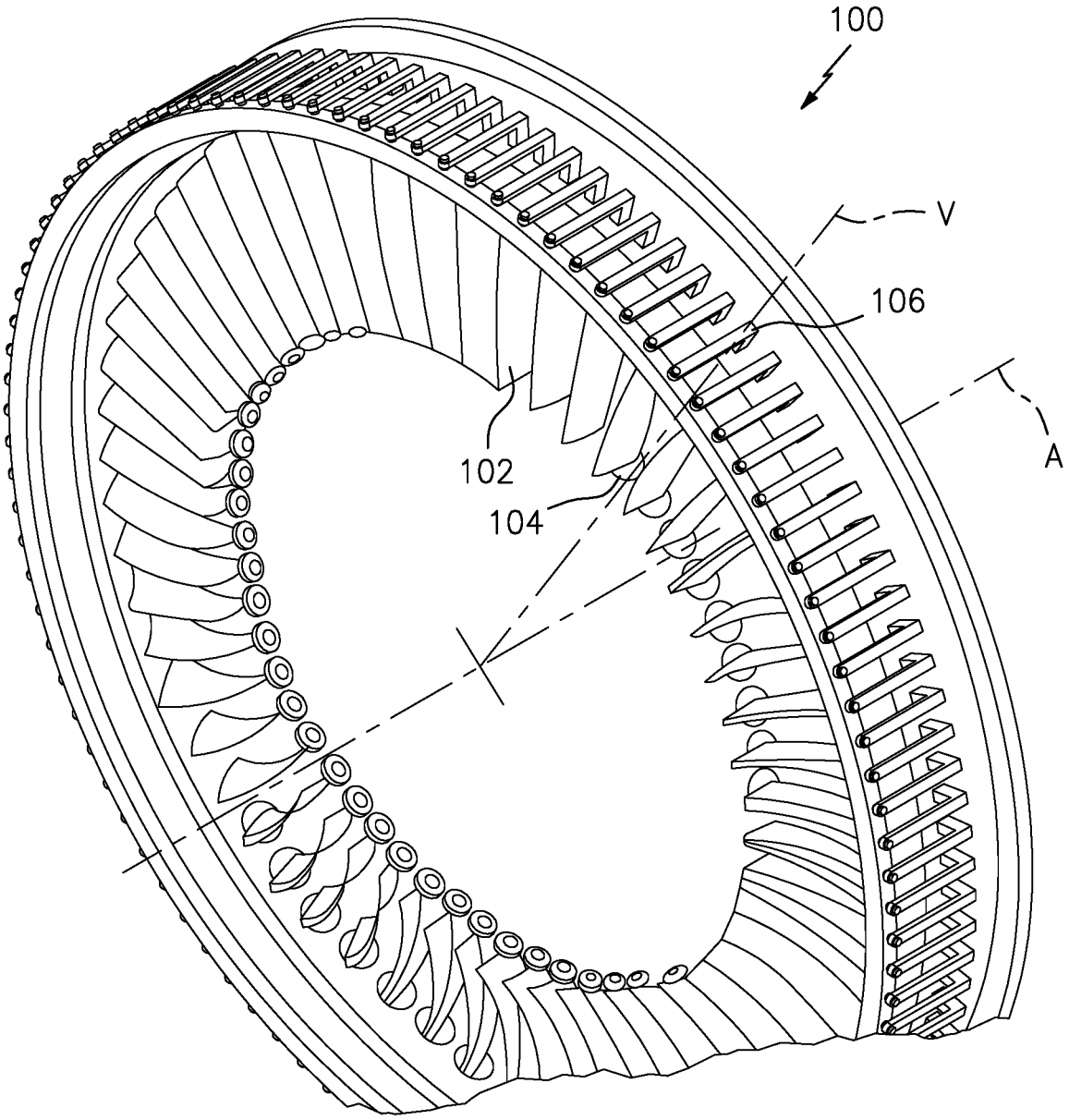
FIG. 3 is a partial perspective view of one stage of a variable vane system for a gas turbine engine.

Each of the variable stator vanes 102 includes an inner pivot pin 104 that is receivable into a corresponding socket (not shown) and an outer trunion 106 mounted through an outer engine case 108 such that each of the variable stator vanes 102 can pivot about a vane axis V (FIG. 3).

The variable vane system 100 further includes a synchronizing ring assembly 110 to which, in one disclosed non-limiting embodiment, each of the outer trunions 106 are attached through a vane arm 112 along a respective axis D. It should be appreciated that although a particular vane arm 112 is disclosed in this embodiment, various linkages of various geometries may be utilized.

Figure 4:
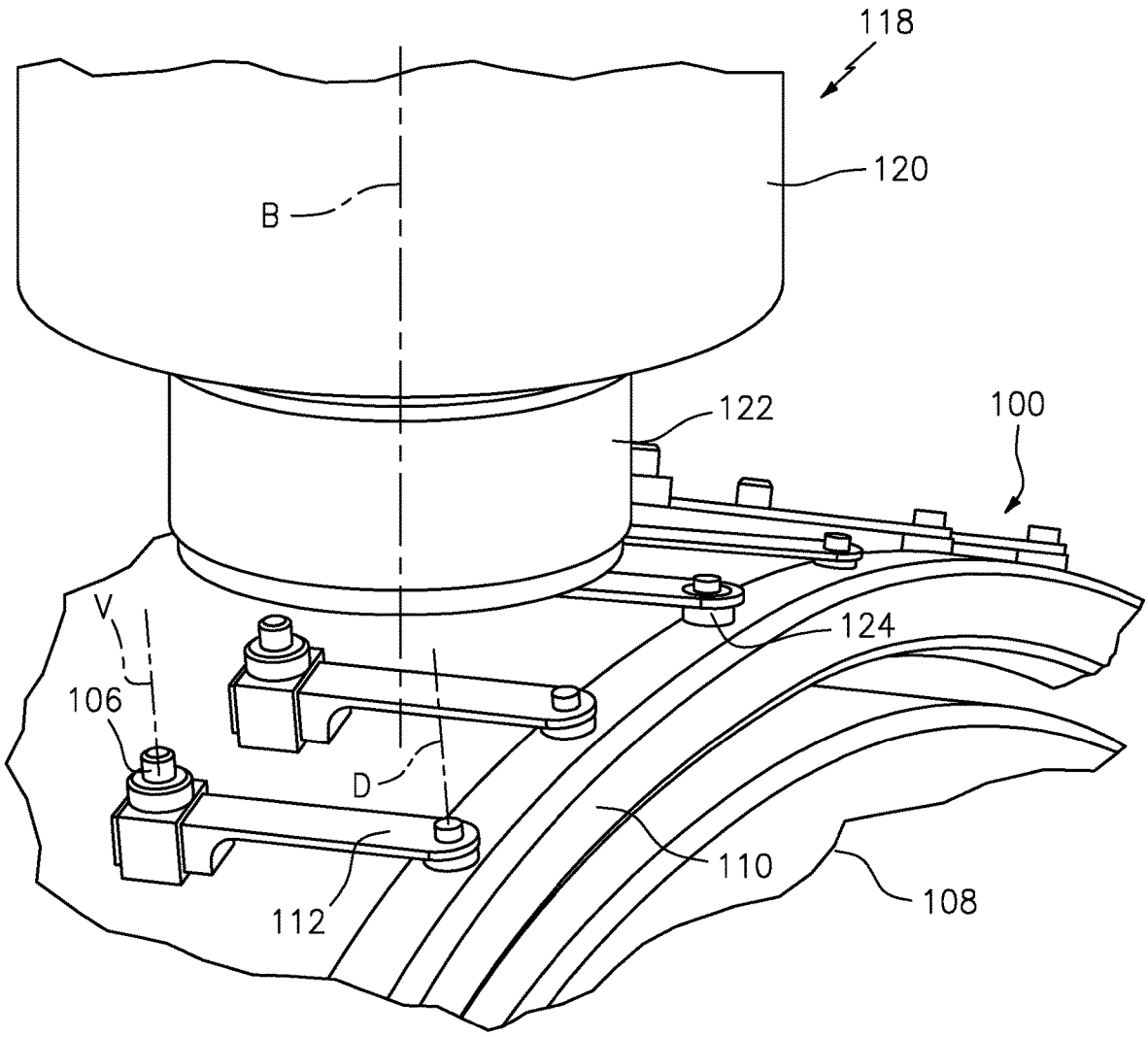
FIG. 4 is a partial perspective view of a variable vane system for a gas turbine engine according to one disclosed non-limiting embodiment.

The variable vane system 100 is driven by an actuator system 118 with an actuator 120, a drive 122 and an actuator arm 124 (also shown in FIG. 4). Although particular components are separately described, it should be appreciated that alternative or additional components may be provided.

Figure 5:
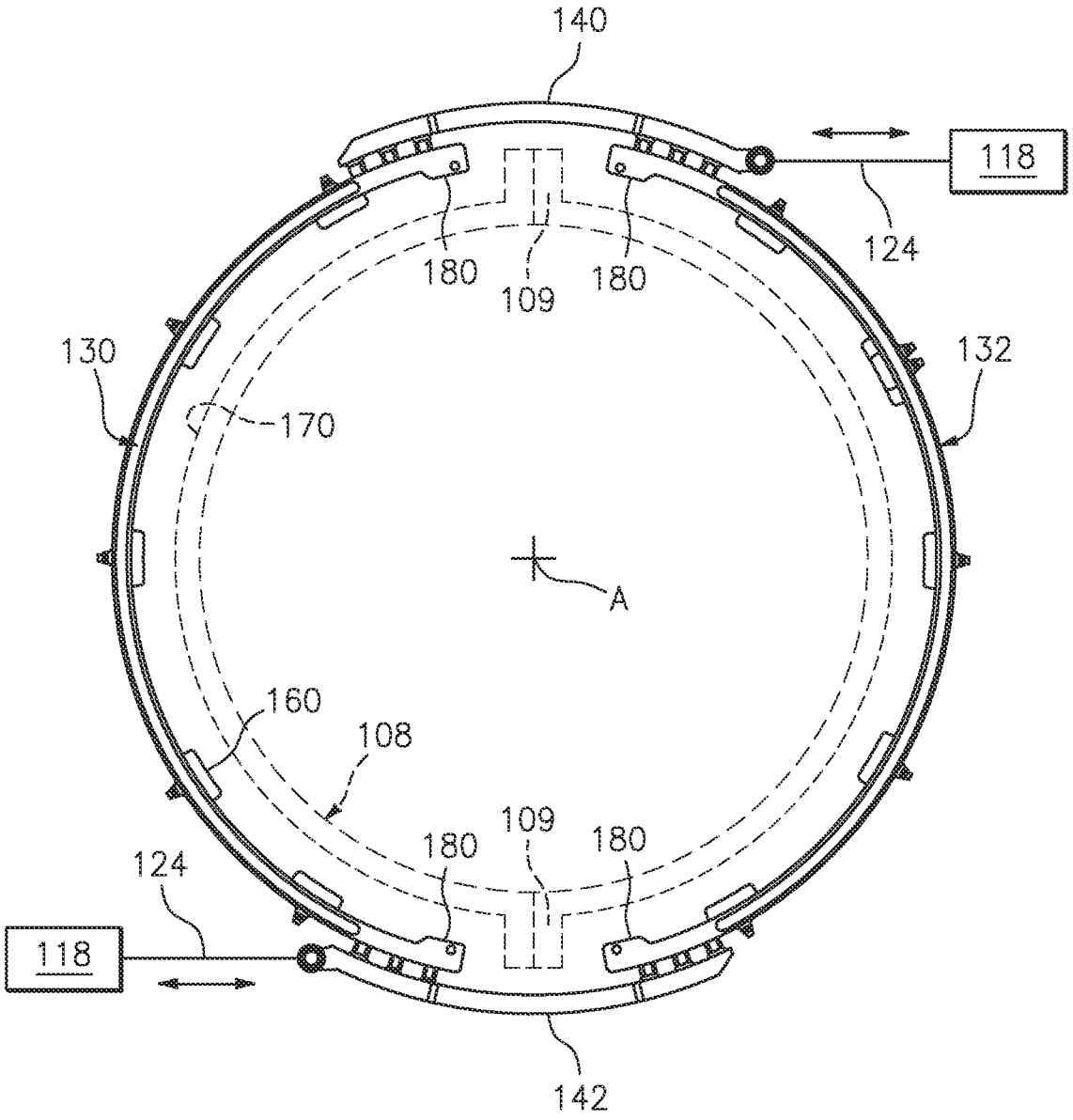
FIG. 5 is a front view of a synchronization ring of the variable vane system.

With reference to FIG. 5, the synchronizing ring assembly 110 includes a first synchronizing ring portion 130, a second synchronizing ring portion 132, and a first and second clevis bridge bracket 140, 142 attached therebetween to bridge the first and second synchronizing ring portion 130, 132. Segregating the synchronizing ring assembly 110 permits the first and second clevis bridge bracket 140, 142 to bridge the split flange 109 typically located in the outer engine case 108.

Figure 6:
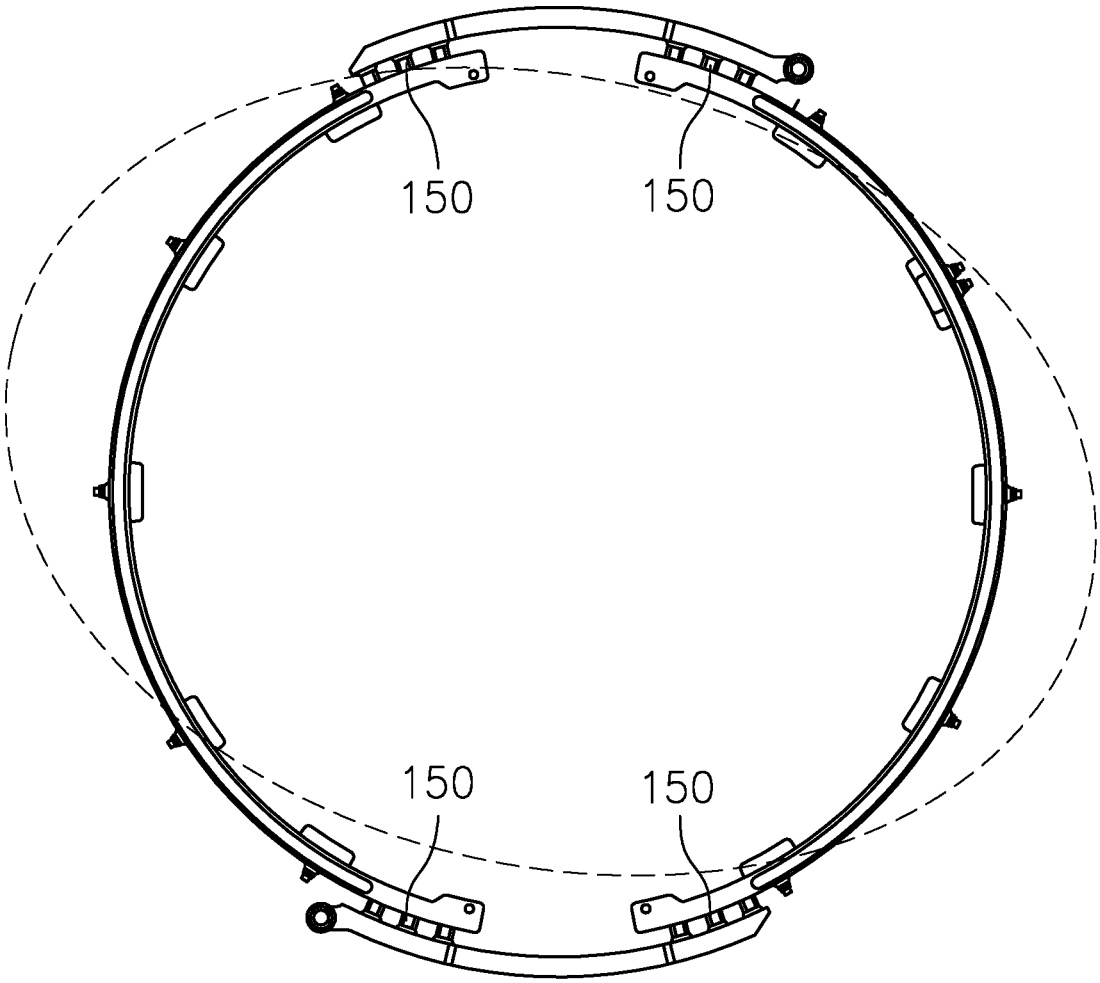
FIG. 6 is a front view of a synchronization ring of the variable vane system showing a deflection from a surge event in phantom.
Figure 7:
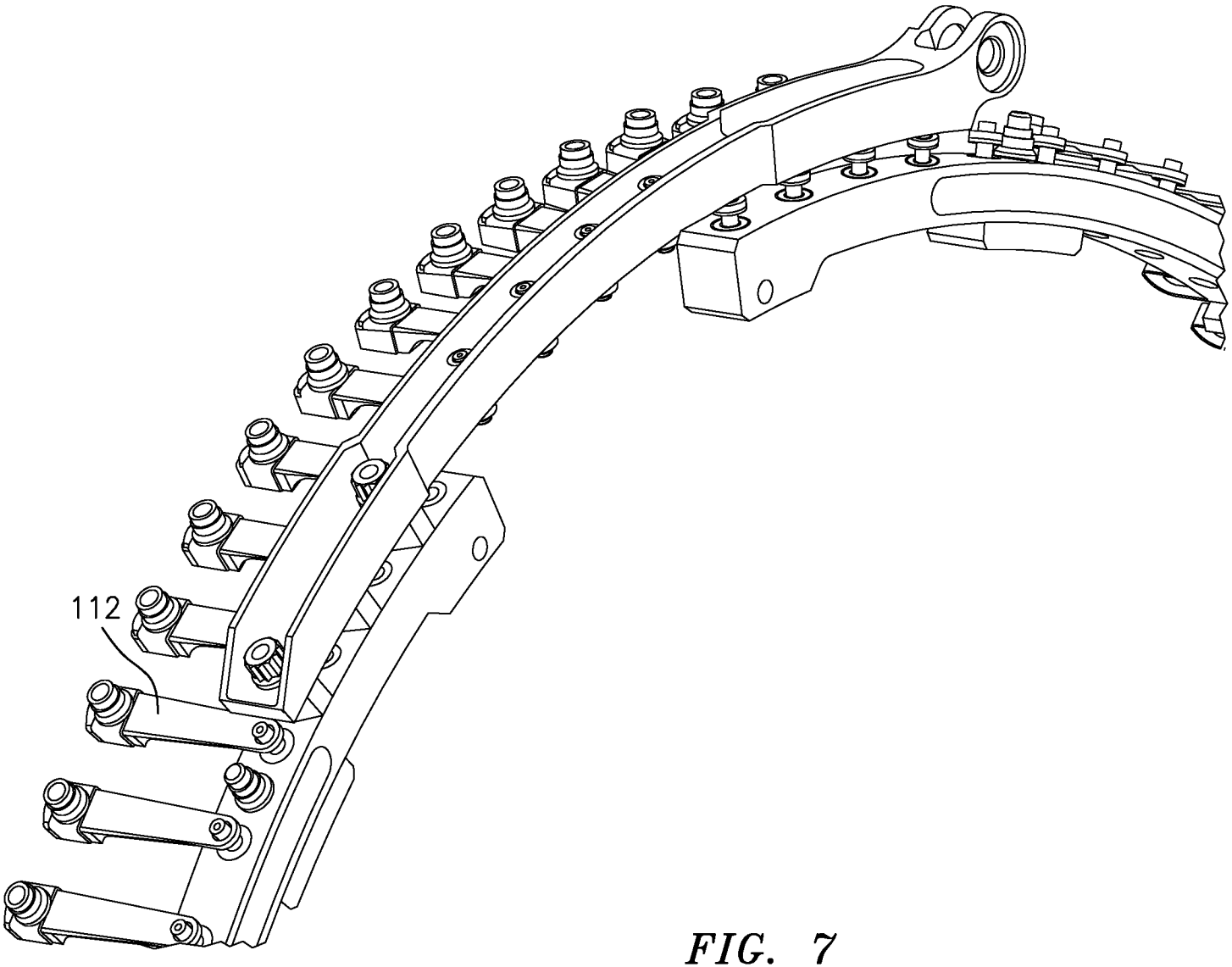
FIG. 7 is a partial perspective view of the variable vane system showing the drive arms attached to the synchronization ring portion.

The first and second clevis bridge bracket 140, 142 are each driven by the actuator arm 124 of the actuator system 118. During a surge, the vane torque creates clockwise torque on the synchronizing ring assembly 110 which is constrained at the clevis bridge bracket attachment points 150 (FIG. 6). The synchronizing ring assembly 110 deflects inboard at that location, and outboard 90° away such that the vane arms 112 located 90° away may fail if the deflection is too great (FIG. 7).

Figure 8:
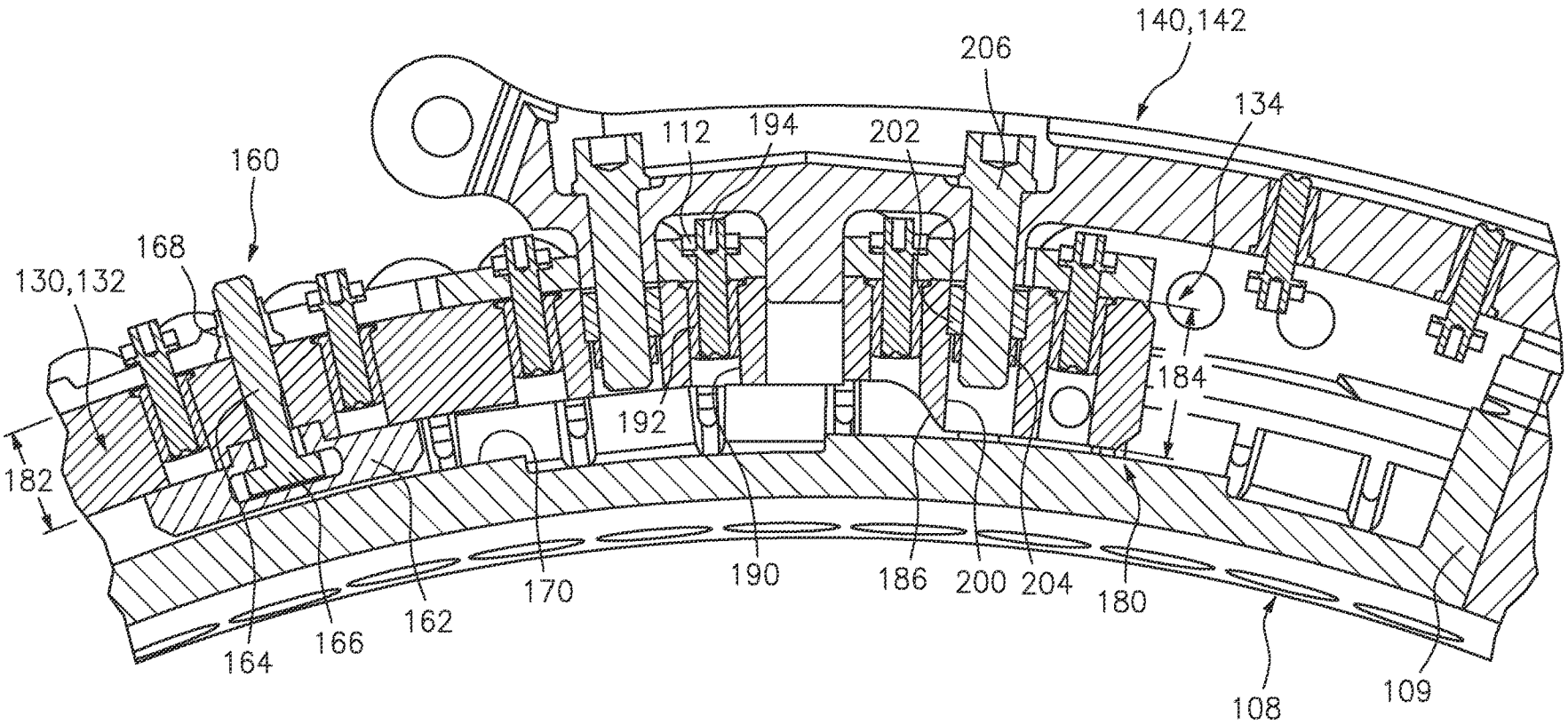
FIG. 8 is a sectional view of a synchronization ring portion according to one disclosed non-limiting embodiment.

With reference to FIG. 8, the synchronizing ring assembly 110 is at least partially supported on the outer engine case 108 by a multiple of bumper assemblies 160. In one example, five bumper assemblies 160 are mounted to each of the first and second synchronizing ring portion 130, 132. Each bumper assembly 160 include a bumper 162 mounted to the respective first and second synchronizing portions 130, 132 via a threaded fastener 164. The threaded fastener 164 includes a head 166 that fits within the bumper 162 and a nut 168 that is threaded to the threaded fastener 164 to retain the bumper 162. In one example, the bumper 162 provides a build gap greater than a minimum gap with respect to an outer surface 170 of the outer engine case 108. Adjustment may be performed via the threaded fastener 164.

Each of the first and second synchronizing ring portion 130, 132 have distal ends 134 that form integrated surge bumpers 180. That is, the surge bumpers 180 are protuberances on an inner diameter of each synchronizing ring portion 130, 132 nearest to the case split flange 109 such that the first and second synchronizing ring portion 130, 132 define a first height 182 throughout the span which then increases to a second height 184 at the distal end. The first and second heights may smoothly interface via a ramp 186. In one example, the distal ends 134 that form the integrated surge bumpers 180 are each of an arc length that is 2-5% of each synchronizing ring portion 130, 132 and, each ring half is about 160° of the overall engine.

In one example, the surge bumpers 180 provides a build gap greater than a minimum gap with respect to the outer surface 170 of the outer engine case 108. In this example, the surge bumpers 180 build gap is 4-5 times that of the bumper 162 and the minimum gap is 15-17 times that of the bumper 162. The normal bumper gaps are set to a minimum so as to keep the ring as circular as possible during operation (the loads deflect the ring into an oval; the higher the load and the larger the gap the more the deflection). The more circular the ring is, the more uniform the variable vane angles are, which translates to better performance. However, if the gaps are too small, the sync ring could bind during an acceleration where the case grows too fast and the sync rings can't catch up, so you do need to have some gap. The surge bumpers 180 need not be coated, and features a larger inner diameter than the regular bumpers so as to not touch the outer engine case during normal operation. During a surge event where excessive deflection occurs, the surge bumper 180 will contact the outer engine case and prevent any further deflection thereby protecting the drive arms 112.

The first and second synchronizing ring portion 130, 132, include a multiple of passages 190 that receive bushings 192. Each bushing 192 supports a respective drive pin 194 which, in turn, link the respective vane arms 112 to the synchronizing ring assembly 110 (FIG. 2).

The first and second synchronizing ring portion 130, 132, likewise include a at least one clevis bridge bracket attachment passages 200. The clevis bridge bracket attachment passages 200 receive bushings 202 that support a nut 204 of a threaded fastener 206 that passes through the respective first and second synchronizing ring portion 130, 132 and the first and second clevis bridge bracket 140, 142. At least one clevis bridge bracket attachment passages 200 is positioned to pass through the second height 184 of each surge bumper 180.

The surge bumpers 180 limit the radial deflection during a high powered surge, where tight vane spacing prevents location of a bumper assembly close to the case split flange. The surge bumpers 180 are also lighter than a regular bumper assembly and without the surge bumpers 180, significant stiffness would have to otherwise be provided into the synchronizing ring, either of a tubular or I-beam type, which would be a detriment to product weight.

The foregoing description is exemplary rather than defined by the limitations within. Various non-limiting embodiments are disclosed herein, however, one of ordinary skill in the art would recognize that various modifications and variations in light of the above teachings will fall within the scope of the appended claims. It is therefore to be understood that within the scope of the appended claims, the disclosure may be practiced other than as specifically described. For that reason the appended claims should be studied to determine true scope and content.

What is claimed is:

1. A synchronizing ring assembly, comprising:

a synchronizing ring portion that has a first distal end and a second distal end, the first distal end and the second distal end each form an integrated surge bumper, wherein the synchronizing ring portion defines a first height throughout a span of the synchronizing ring portion, the first height increases to a second height at the first distal end and the second distal end of the synchronizing ring portion; and a bumper assembly mounted to the synchronizing ring portion, a build gap of the integrated surge bumper with respect to an outer surface of an outer case is 4-5 times a build gap of the bumper assembly with respect to the outer surface of the outer case.

2. The assembly as recited in claim 1, further comprising a ramp between the first height and the second height.

3. The assembly as recited in claim 1, wherein the synchronizing ring portion is of a 180 degree arc length.

4. The assembly as recited in claim 1, wherein each integrated surge bumper is of an arc length that is 2-5% that of the synchronizing ring portion.

5. The assembly as recited in claim 1, wherein a minimum gap of the integrated surge bumper with respect to the outer surface of the outer case is 15-17 times that of a minimum gap of the bumper assembly with respect to the outer surface of the outer case.

6. The assembly as recited in claim 1, wherein each integrated surge bumper includes a clevis bridge bracket attachment passage.

7. The assembly as recited in claim 6, wherein the clevis bridge bracket attachment passage is fastened to the synchronizing ring portion.

8. A synchronizing ring assembly, comprising:

a first synchronizing ring portion that has a first distal end and a second distal end, the first distal end and the second distal end each form an integrated surge bumper;

a second synchronizing ring portion that has a first distal end and a second distal end, the first distal end and the second distal end each form an integrated surge bumper;

a first clevis bridge bracket fastened to the first synchronizing ring portion and the second synchronizing ring portion;

a second clevis bridge bracket fastened to the first synchronizing ring portion and the second synchronizing ring portion; and a multiple of bumper assemblies fastened to the first synchronizing ring portion and the second synchronizing ring portion, a build gap of the integrated surge bumpers with respect to an outer surface of an outer case is 4-5 times a build gap of each of the multiple of bumper assemblies with respect to the outer surface of the outer case.

9. The assembly as recited in claim 8, wherein the first and second synchronizing ring portion each defines a first height throughout a span and a second height at the first and second distal end to form the integrated surge bumper, each integrated surge bumper includes a clevis bridge bracket attachment passage.

10. The assembly as recited in claim 9, wherein each integrated surge bumper provides a build gap greater than a minimum gap with respect to the outer surface of the outer case.

11. The assembly as recited in claim 9, wherein a minimum gap of the integrated surge bumper with respect to the outer surface of the outer case is 15-17 times that of a minimum gap of the bumper assembly with respect to the outer surface of the outer case.

12. The assembly as recited in claim 8, wherein a minimum gap of the integrated surge bumper with respect to the outer surface of the outer case is 15-17 times that of a minimum gap of the bumper assembly with respect to the outer surface of the outer case.

13. A method of controlling a deflection of a synchronizing ring assembly during a surge event in a gas turbine engine, comprising:

providing a build gap with respect to an outer surface of an outer engine case for an integrated surge bumper at each distal end of a synchronization ring portion a build gap with respect to the outer surface of the outer case is 4-5 times that of a bumper assembly attached to the synchronization ring portion; and providing a minimum gap with respect to the outer surface of the outer engine case for the integrated surge bumper at each distal end of the synchronization ring portion that is 15-17 times that of a minimum gap of a bumper assembly attached to the synchronization ring portion with respect to the outer surface of the outer case.

14. The method as recited in claim 13, further comprising providing a rotational input to the synchronizing ring assembly through a clevis bridge bracket fastened to the synchronizing ring portion.

* * * * *